US010030515B2

(12) United States Patent
Weber et al.

(10) Patent No.: US 10,030,515 B2
(45) Date of Patent: Jul. 24, 2018

(54) TOOL HOLDER AND BASE MOUNTING ASSEMBLY

(71) Applicant: Kennametal Inc., Latrobe, PA (US)

(72) Inventors: Luke A. Weber, Bedford, PA (US); Eric P. Helsel, New Enterprise, PA (US); Brian K. Lavely, Ebensburg, PA (US); Timothy A. LaMantia, Seward, PA (US); Donald E. Keller, Bedford, PA (US)

(73) Assignee: KENNAMETAL INC., Latrobe, PA (US)

( * ) Notice: Subject to any disclaimer, the term of this patent is extended or adjusted under 35 U.S.C. 154(b) by 2 days.

(21) Appl. No.: 14/620,841

(22) Filed: Feb. 12, 2015

(65) Prior Publication Data

US 2016/0237818 A1 Aug. 18, 2016

(51) Int. Cl.
*E21C 35/19* (2006.01)

(52) U.S. Cl.
CPC ..... *E21C 35/19* (2013.01); *E21C 2035/191* (2013.01)

(58) Field of Classification Search
CPC ..... E21C 2035/191; E21C 35/19
See application file for complete search history.

(56) References Cited

U.S. PATENT DOCUMENTS 4,316,636 A * 2/1982 Taylor ..... B28D 1/188 175/413
6,176,552 B1 1/2001 Topka, Jr. et al.
6,244,665 B1 6/2001 Bise et al.
6,331,035 B1 * 12/2001 Montgomery, Jr. .... E21C 35/18 299/102
6,364,420 B1 * 4/2002 Sollami ..... B28D 1/188 299/104
6,478,383 B1 11/2002 Ojanen et al.
6,481,803 B2 11/2002 Ritchey
6,786,557 B2 9/2004 Montgomery, Jr.
8,523,290 B2 * 9/2013 Helsel ..... E21C 35/18 299/105
2011/0089746 A1 4/2011 Helsel et al.
2011/0089747 A1 4/2011 Helsel et al.
2011/0233987 A1 9/2011 Maushart
2012/0062017 A1 3/2012 Maushart et al.

FOREIGN PATENT DOCUMENTS

DE 102011051525 A1 1/2013

OTHER PUBLICATIONS

Aug. 31, 2016—First Office Action.

* cited by examiner

*Primary Examiner* — John J Kreck
(74) *Attorney, Agent, or Firm* — Ian K. Samways

(57) ABSTRACT

A mounting assembly adapted for attachment to a surface of a rotatable driving member of a cutting tool machine and adapted for receiving a cutting tool includes: a base having a bottom portion for attachment to the surface of the rotatable driving member and a front portion that defines a bore; and a tool holder configured for mounting to the base. The tool holder includes: a leading head region having a forward face that defines an aperture for receiving the cutting tool; a trailing shank region with a central longitudinal axis and having an axial forward end and an axial rearward end; and a mediate region intermediate of and contiguous with the leading head region and the trailing shank region. The trailing shank region includes an anti-rotation portion and a mounting retention portion.

18 Claims, 8 Drawing Sheets

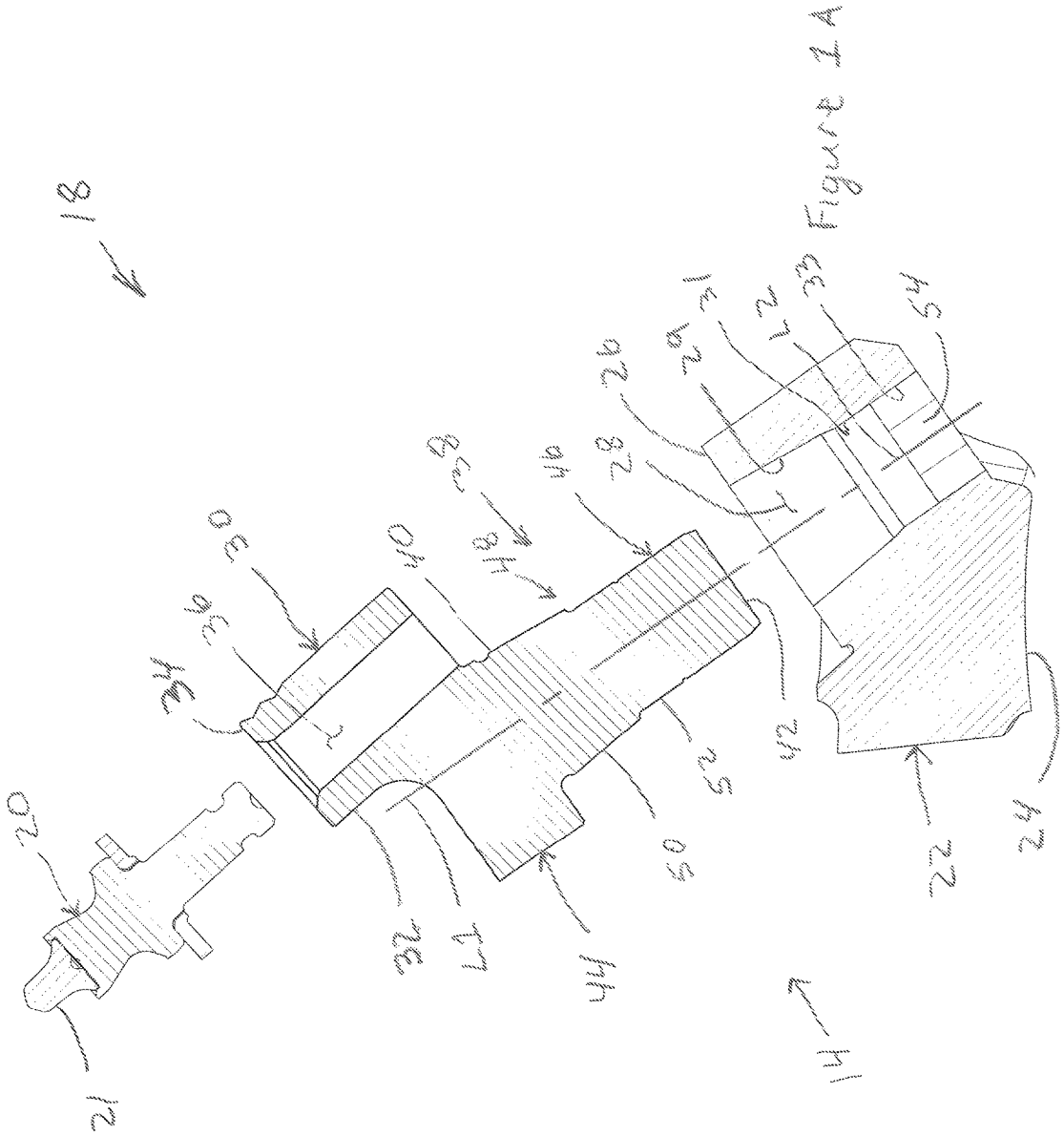
18
12
20
36
34
38
40
38
40
42
44
46
48
50
52
54
56
58
60
62
64
66
68
70
72
74
76
78
80
82
84
86
88
90
92
94
96
98
100
102
104
106
108
110
112
114
116

TOOL HOLDER AND BASE MOUNTING ASSEMBLY

BACKGROUND OF THE INVENTION

The invention pertains generally to a rotatable cutting tool-tool holder-base assembly, as well as the individual components of the assembly. One typically uses such an assembly in conjunction with the rotatable drum or driven member. The driven member rotates in such a fashion to drive the rotatable cutting tool into earth strata to disintegrate the same into smaller pieces including fine particulates, i.e., cutting debris. Such a rotatable cutting tool-tool holder-base assembly has application in a number of specific environments. One specific environment is mining as a component of a mining machine. Another specific environment is road construction as a component of a road planing machine or a road milling machine.

Mining machines and construction machines (e.g., a road planing machine or road milling machine) are useful in continuous mining or road milling applications to mine or mill earth strata such as, for example, coal, asphalt, concrete and the like. These mining machines and construction machines utilize cutting bit assemblies. Each cutting bit assemblies for continuous mining or road milling applications typically comprises a cutting bit rotatably mounted within a support block base. In turn, the support block mounts, typically by welding, on a drum or other body, wherein a suitable power source (or means) drives the drum.

During operation of the mining or construction machine, the support block experiences wear due to exposure thereof to the cutting debris. Over time, wear and other kinds of abuse causes the support block to become ineffective which signals an end to its useful life. Once this occurs, the operator must cut or torch the support block off the drum to allow for replacement of the support block. Typically, the operator welds the replacement support block on the drum. As the skilled artisan appreciates, it is time-consuming, and hence costly, to remove and replace a support block. Thus, there is an advantage to be able to prolong the useful life of the support block.

To prolong the life of the support block, one may use a cutting bit holder, sometimes referred to as, for example, a cutting bit sleeve or tool holder, wherein the cutting bit rotatably or otherwise releasably mounts within the cutting bit holder. The cutting bit holder mounts within the support block via a mechanical connection. The presence of the cutting bit holder helps protect the support block from abuse and wear, thus minimizing or eliminating the periods of down time otherwise required for drum repair. The skilled artisan is aware of the use of cutting bit holder.

The skilled artisan is aware that cutting bits and cutting bit holders are subjected to considerable stresses during mining operations, road milling operations or other like operations. Accordingly, there is a desire to mount the cutting bit holder in the support block to minimize movement of the cutting bit holder in order to maximize the useful life of the cutting bit.

It is also important that the mounting between the cutting bit holder and the support block be resistant to vibratory loosening which could likewise lead to premature cutting bit wear and failure. Heretofore, various structures exist to mount a cutting bit sleeve within a support block in an attempt to minimize cutting bit holder movement or loosening, while maximizing cutting bit life.

A mining machine or a road milling machine operates typically in severe operating conditions. During operation, the cutting bit holder (or tool holder) and/or the support block (or base) can experience damage such that it is difficult to disassemble these components. It is an advantage to be able to disassemble the cutting bit holder from the support block. Thus, it would be highly desirable to provide a cutting bit holder-support block assembly that facilitates a relatively easy disassembly of the cutting bit holder from the support block. Further, during operation, the severe operating conditions can also cause the rotatable cutting bit to lodge in the bore of the cutting bit holder. It would be advantageous to disassemble the cutting bit from the cutting bit holder. Thus, it is highly desirable to provide a cutting bit-cutting bit holder assembly that facilitates the relatively easy disassembly of the cutting bit from the cutting bit holder.

Thus, it would be highly desirable to provide an improved mounting assembly relating to the type described herein that overcomes disadvantages and shortcomings of heretofore known such assemblies.

SUMMARY OF THE INVENTION

In accordance with an aspect of the invention, a mounting assembly adapted for attachment to a surface of a rotatable driving member of a cutting tool machine and adapted for receiving a cutting tool comprises: a base having a bottom portion for attachment to the surface of the rotatable driving member and a front portion that defines a bore; and a tool holder configured for mounting to the base. The tool holder comprises: a leading head region having a forward face that defines an aperture for receiving the cutting tool; a trailing shank region with a central longitudinal axis and having an axial forward end and an axial rearward end; and a mediate region intermediate of and contiguous with the leading head region and the trailing shank region. The trailing shank region comprises an anti-rotation portion and a mounting retention portion.

In accordance with another aspect of the invention, a tool holder of a mounting assembly adapted for attachment to a surface of a rotatable driving member of a cutting tool machine, the tool holder adapted for receiving a cutting tool, comprises: a leading head region having a forward face that defines an aperture for receiving the cutting tool; a trailing shank region with a central longitudinal axis and having an axial forward end and an axial rearward end; and a mediate region intermediate of and contiguous with the leading head region and the trailing shank region. The trailing shank region comprises an anti-rotation portion and a mounting retention portion.

In accordance with another aspect of the invention, a tool holder of a mounting assembly adapted for attachment to a surface of a rotatable driving member of a cutting tool machine, the tool holder adapted for receiving a cutting tool, the tool holder comprising: a head having a forward face that defines an aperture for receiving the cutting tool; and a shank with a central longitudinal axis and having an axial forward end and an axial rearward end. The shank comprises an anti-rotation portion and a mounting retention portion. The anti-rotation portion and the mounting retention portion are configured as a single member disposed about the central longitudinal axis of the trailing shank region. The mounting retention portion includes a tapered press fit portion that tapers axially rearward and a generally cylindrical press fit portion.

These and other aspects of the present invention will be more fully understood following a review of this specification and drawings.

BRIEF DESCRIPTION OF THE DRAWINGS

FIG. 1A is a sectional view (taken in the plane of the FIG. 1 page) of the rotatable cutting tool-tool holder-base assembly shown as an exploded assembly in FIG. 1, in accordance with an aspect of the invention.

FIG. 6 is a side view of an additional cutting tool-tool holder-base mounting assembly, in accordance with an aspect of the invention

DETAILED DESCRIPTION

The following description is for purposes of illustrating various aspects of the invention only and not for purposes of limiting the scope of the invention.

Figure 1:
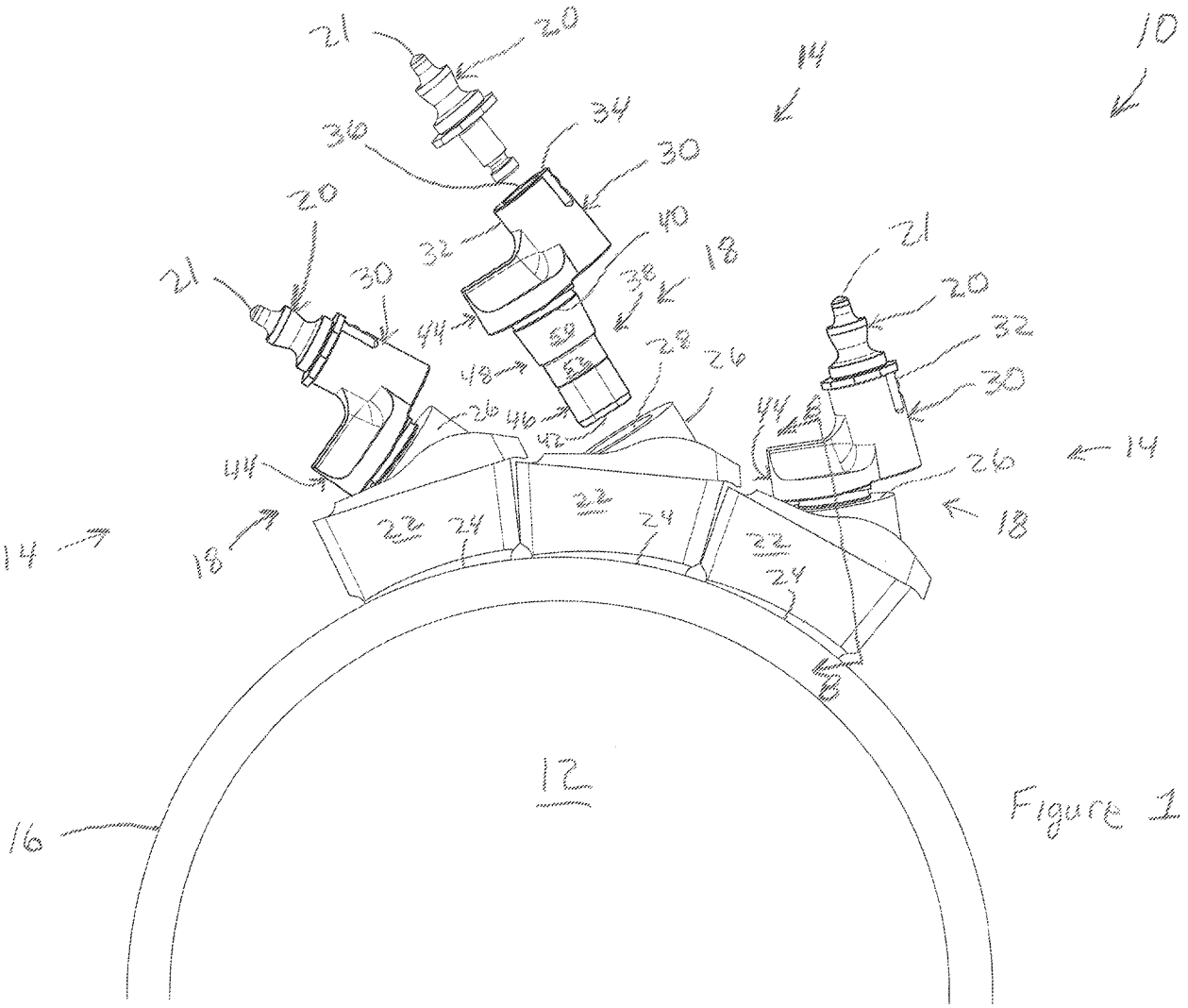
FIG. 1 is a side view of a portion of a rotatable drum (i.e., a rotatable driving member) showing three rotatable cutting tool-tool holder-base assemblies attached to the surface of the rotatable drum, in accordance with an aspect of the invention.

FIG. 1 is a side view of a cutting assembly, generally designated as reference number 10, in accordance with various aspects of the invention. Specifically, FIG. 1 illustrates a portion of a rotatable drum 12 (i.e., a rotatable driving member), which could be used, for example, in a mining machine or a road milling machine. FIG. 1 also illustrates three rotatable cutting tool-tool holder-base assemblies 14 attached to a surface 16 of the rotatable drum 12.

It will be appreciated that the invention has application to various kinds of cutting tools useful in various kinds of cutting operations. Exemplary operations include, without limitation, road planing (or milling), coal mining, concrete cutting, and other kinds of cutting operations wherein a cutting tool with a hard cutting member impinges against a substrate (e.g., earth strata, pavement, asphaltic highway material, concrete, minerals and the like) breaking the substrate into pieces of a variety of sizes including larger-size pieces or chunks and smaller-sized pieces including dust-like particles. In addition, it will be appreciated that the assembly 10 of the invention, and components thereof, may be manufactured in various sizes and dimensions depending upon the desired application of the assembly 10.

Figure 2A:
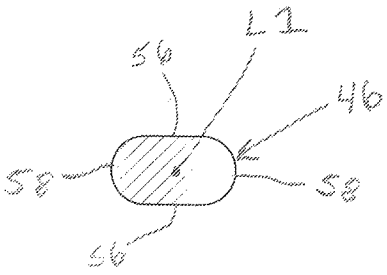
FIG. 2A is a sectional view along line A-A of FIG. 2, in accordance with an aspect of the invention.
Figure 2B:
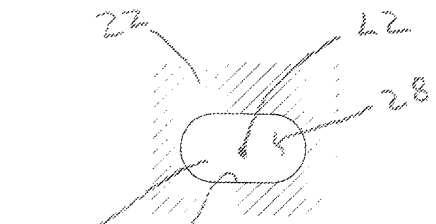
FIG. 2B is a sectional view along line B-B of FIG. 2, in accordance with an aspect of the invention.
Figure 2:
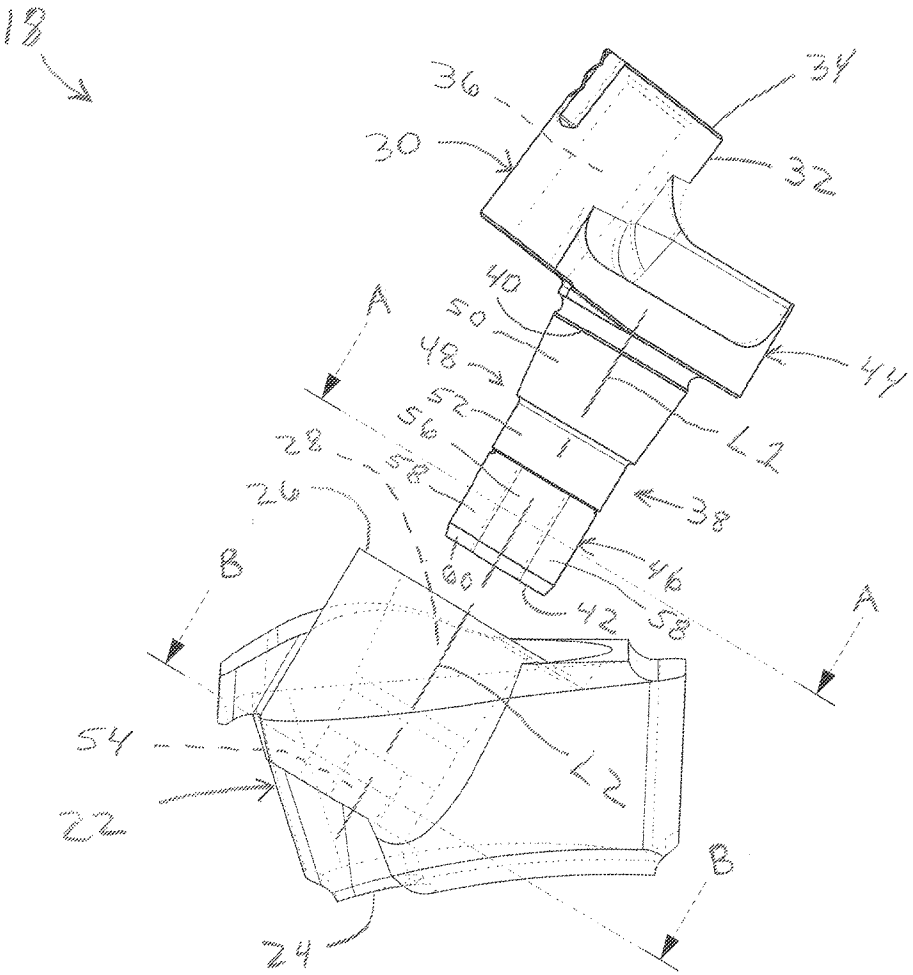
FIG. 2 is a side view of one of the tool holder-base mounting assemblies of FIG. 1, in accordance with an aspect of the invention.
Figure 3:
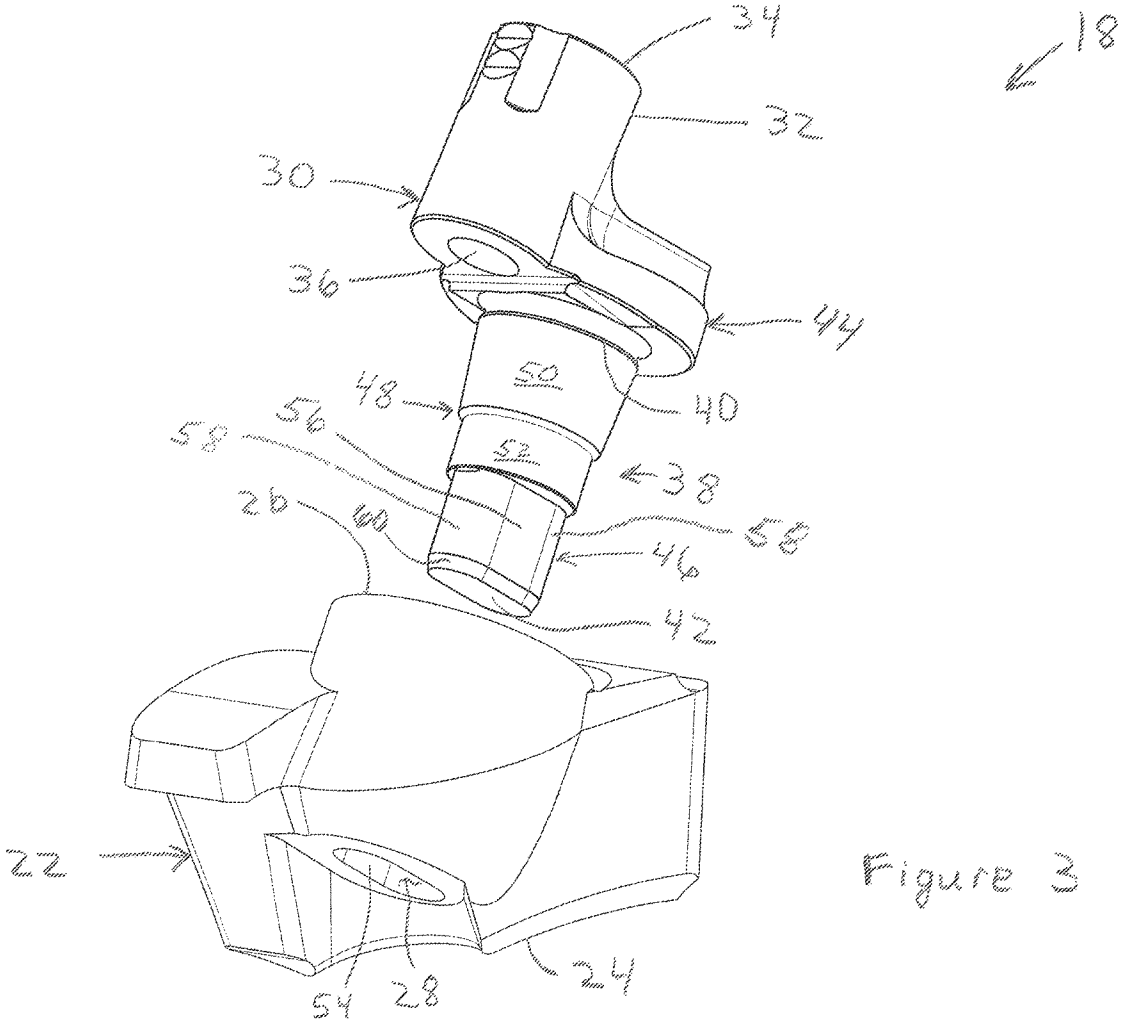
FIG. 3 is an isometric view of one of the tool holder-base mounting assemblies of FIG. 1, in accordance with an aspect of the invention.

Referring to FIGS. 1-3, a mounting assembly 18 of the cutting tool-tool holder-base assemblies 14 is illustrated, in accordance with various aspects of the invention. Generally, the mounting assembly 18 is adapted for attachment to the surface 16 of the rotatable driving member 12 of the cutting assembly 10 and is further adapted for receiving a cutting tool 20. Typically, the cutting tool 20 is a rotatable cutting tool with a hard cutting member 21 for impinging against a substrate, e.g., earth strata, pavement, asphaltic highway material, concrete, minerals and the like as is well known in the art.

The mounting assembly 18 includes a base 22 having a bottom portion 24 for attachment to the surface 16 of the rotatable driving member 12. The base 22 also includes a front portion 26 that defines a bore 28. In one aspect, the bore 28 includes a mounting retention section including, but not limited to, a tapered section 29 and a generally cylindrical section 31. In another aspect, the bore 28 includes an anti-rotation section 33 at an axial rearward end 54 thereof.

The mounting assembly 18 also includes a tool holder 30 configured for mounting to the base 22. In one aspect, the tool holder 30 includes a leading head region 32 having a forward face 34 that defines an aperture 36 for receiving the cutting tool 20. The tool holder 30 also includes a trailing shank region 38 with a central longitudinal axis L1 (shown, for example, in FIGS. 1A and 2). The trailing shank region 38 has an axial forward end 40 and an axial rearward end 42. The tool holder 30 also includes a mediate region 44 intermediate of and contiguous with the leading head region 32 and the trailing shank region 38.

In accordance with another aspect of the invention, the trailing shank region 38 of the tool holder 30 includes an anti-rotation portion 46 and a mounting retention portion 48. As will be appreciated from the description herein, the anti-rotation portion 46 and the mounting retention portion 48 cooperate or work in conjuntion to securely retain the tool holder 30 in the bore 28 of the base 22 while also reducing, minimizing and/or preventing the tool holder 30 from rotating with respect to the base 22 while mounted therein. In one aspect, the anti-rotation portion 46 is adjacent the axial rearward end 42 of the trailing shank region 38.

In accordance with an aspect of the invention, the mounting retention portion 48 can include one or more sections or portions designed to securely mount and maintain tool holder 30 in the bore 28 of the base 22 during installation and/or use of the components. In one particular aspect, the mounting retention portion 48 can include a tapered press fit portion 50 that tapers axially rearward toward the anti-rotation portion 46, i.e., tapers axially rearward toward the axial rearward end 42 of the trailing shank region 38. In another particular aspect, the mounting retention portion 48 can include a generally cylindrical press fit portion 52 axially rearward of the tapered press fit portion 50 and adjacent the anti-rotation portion 46.

It will be appreciated that the mounting retention portion 48 may have one or more components, e.g., the tapered press fit portion 50 and cylindrical press fit portion 52 or like or similar components in various combinations, and that the one or more components that make up the mounting retention portion 48 may have different configurations, shapes, orientations, etc. that structurally and functionally serve the purpose for which the mounting retention portion 48 is intended.

In another aspect of the invention as illustrated, for example, in FIGS. 2-2A, the bore 28 of the base 22 is configured for receiving at least a portion of the trailing shank region 38 of the tool holder 30. In one aspect, the axial rearward end 54 of the bore 28 is configured to have a shape similar to and/or complimentary to the anti-rotation portion 46 of the trailing shank region 38. For example, FIG. 2A illustrates one possible shape of a cross-section of the anti-rotation portion 46 that is capable of being received in the axial rearward end 54 of the bore 28 that is configured to have a shape similar to and/or complimentary to the anti-rotation portion 46, as shown in FIG. 2B.

It will be appreciated that the anti-rotation portion 46 may have various different configurations, shapes, orientations, cross-sectional shapes, etc. that structurally and functionally serve the purpose for which the anti-rotation portion 46 is intended, namely for reducing, minimizing and/or preventing the tool holder 30 from rotating with respect to the base 22 while mounted therein.

In another aspect, there is a slight lead in chamfer on press fit area 52. The ratio of about ½ the area of 56 and 58 combined are >cross-sectional area of 2A. Equal and opposite radii "corners" of 58 are expected to be in compression from tool holder torque. This torque is due to this system being placed on a Lean and Skew coordinate system not parallel to that of the cylindrical plane/path of the cutting arc that the cutting tool tip is moving.

In one aspect, the bore 28 can include a central longitudinal axis L2 that coincides with the central longitudinal axis L1 of the trailing shank region 38. However, in another aspect the axis L2 may be oriented to not coincide with axis L1 as well.

In another aspect of the invention, the anti-rotation portion 46 and the mounting retention portion 48 are configured as a single or unitary member disposed about or extending along the central longitudinal axes L1 and/or L2. In another aspect, the anti-rotation portion 46 (such as shown, for example, in FIG. 2A) and/or the mounting retention portion 48 may be symmetrical about the central longitudinal axis L1. However, it will be appreciated that the anti-rotation portion 46 and/or the mounting retention portion 48 may be asymmetrical about the central longitudinal axis L1.

In another aspect, the axial rearward end 54 of the bore 28 is configured to be symmetrical about the central longitudinal axis L2 (such as shown, for example, in FIG. 2B). However, it will be appreciated that the axial rearward end 54 of the bore 28 may be asymmetrical about the central longitudinal axis L2.

As shown, for example, in FIG. 2A, in one aspect of the invention the anti-rotation portion 46 has a generally non-circular cross-section. However, it will be appreciated that the anti-rotation portion 46 may have other cross-sectional shapes or configurations as well that provide the anti-rotation aspects of the invention.

In another aspect, the anti-rotation portion 46 has opposing sides 56 (that may be, for example, generally flat, planar and/or straight portions) with opposing rounded or semi-circular or semi-cylindrical ends 58. The anti-rotation portion 46 may also have a chamfer 60 formed at or around at least a portion of the axial rearward end 42 of the trailing shank region 38.

During installation of the tool holder 30 in the bore 28 of the base 22, the initial contact and alignment of the tool holder 30 and base 22 is the chamfer 60 at the axial rearward end 42 in conjunction with the anti-rotation portion 46, specifically the anti-rotation portion 46 is a slip fit across its narrowest section of the sides 56 (as shown, for example, in FIG. 2A) and the anti-rotation section 33 of the axial rearward end 54 of bore 28 (as shown, for example, in FIG. 2B).

The cylindrical press fit portion 52 begins to engage in bore 28, specifically to engage cylindrical section 31. To finish installation tapered press fit portion 50 seats on the tapered section 29 of bore 28. During the life of assembly 18 through general vibration and forces acting along the axis L1 & L2 of the mounting retention portion 48 and bore 28, the press fit area 52 and tapered portion 50 will increase their interference fit area and locking taper and therefore overall retention.

In another aspect, a rearward surface 53 of cylindrical press fit portion 52 does not bottom out or contact surface 55 of the bore 28 during the life of the tool holder to let this system "work" itself tighter during its life.

Figure 1B:
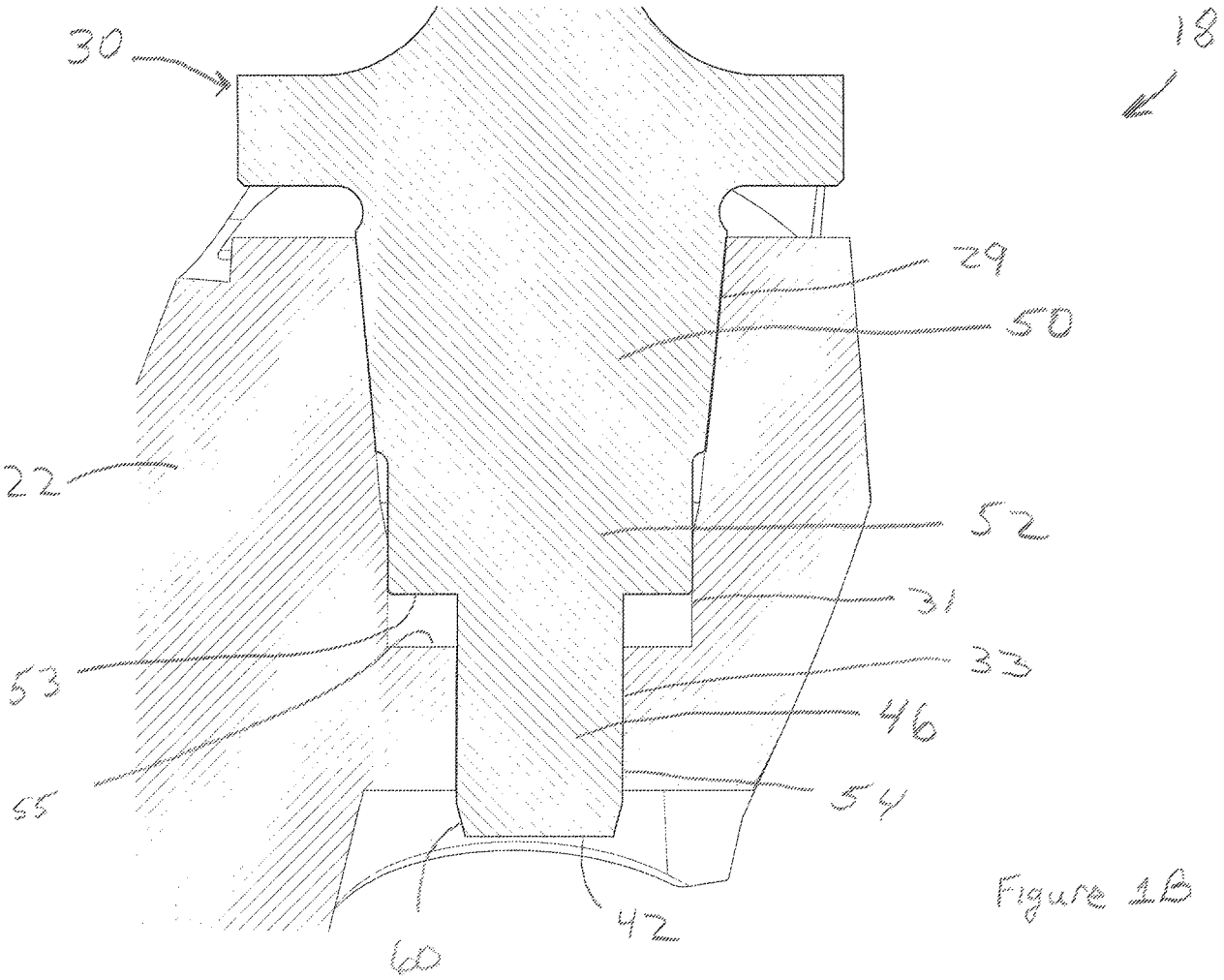
FIG. 1B is a sectional view taken along line B-B of FIG. 1, in accordance with an aspect of the invention

In another aspect, the axial rearward end 42 and/or the chamfer 60 extrude or extend a small amount through the axial rearward end 54 of the bore 28 to provide an impact area on the tool holder 30 to initiate removal from the bore 28 (see, for example, FIG. 1B).

Figure 4:
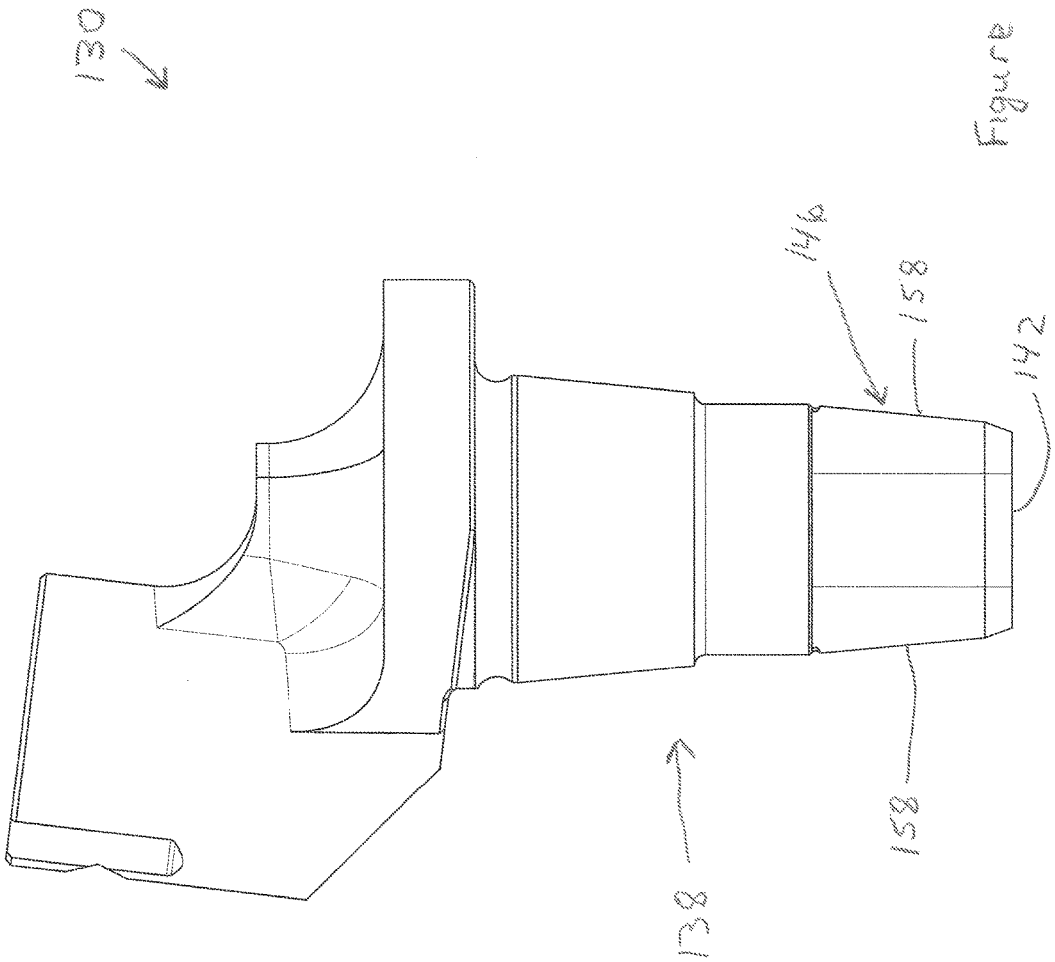
FIG. 4 is a side view of an additional tool holder, in accordance with another aspect of the invention.
Figure 5:
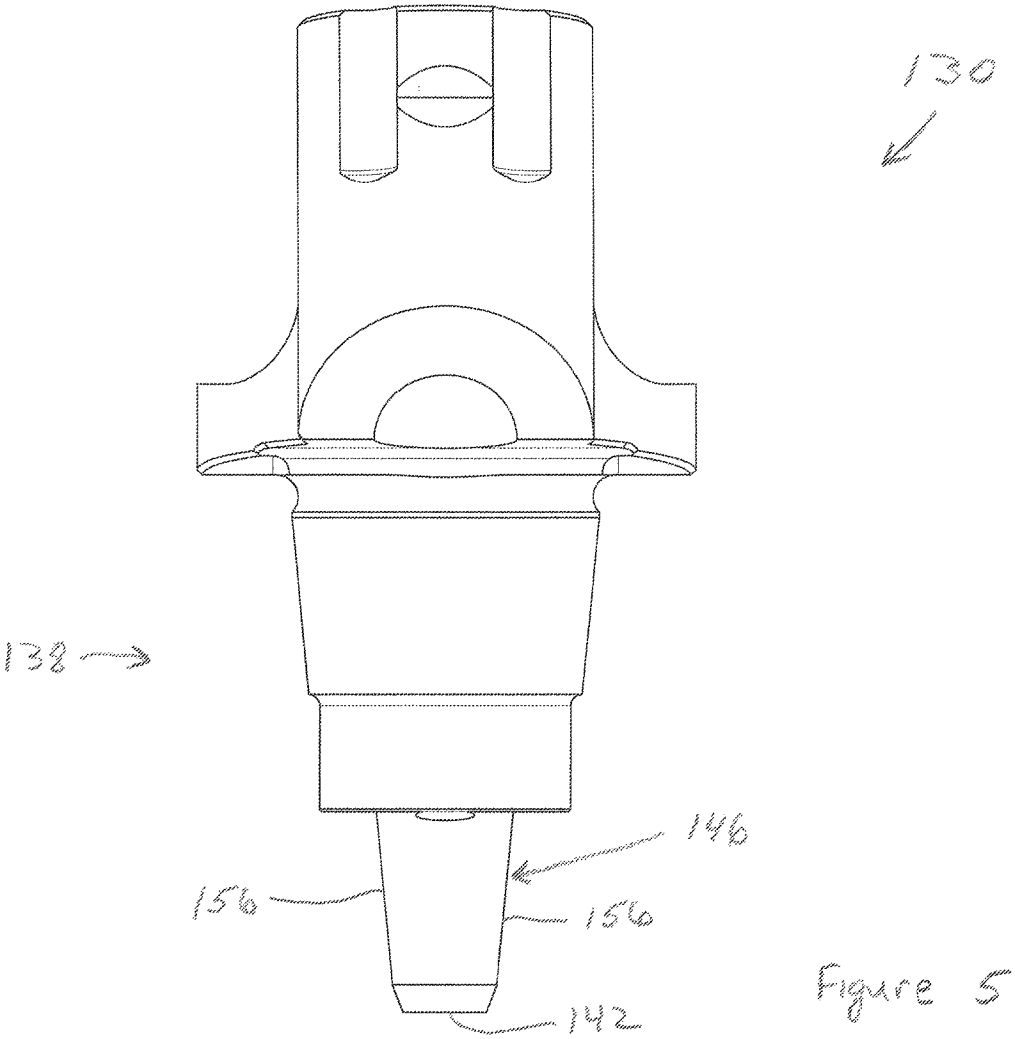
FIG. 5 is a front view of the additional tool holder shown in FIG. 4, in accordance with an aspect of the invention.
Figure 9:
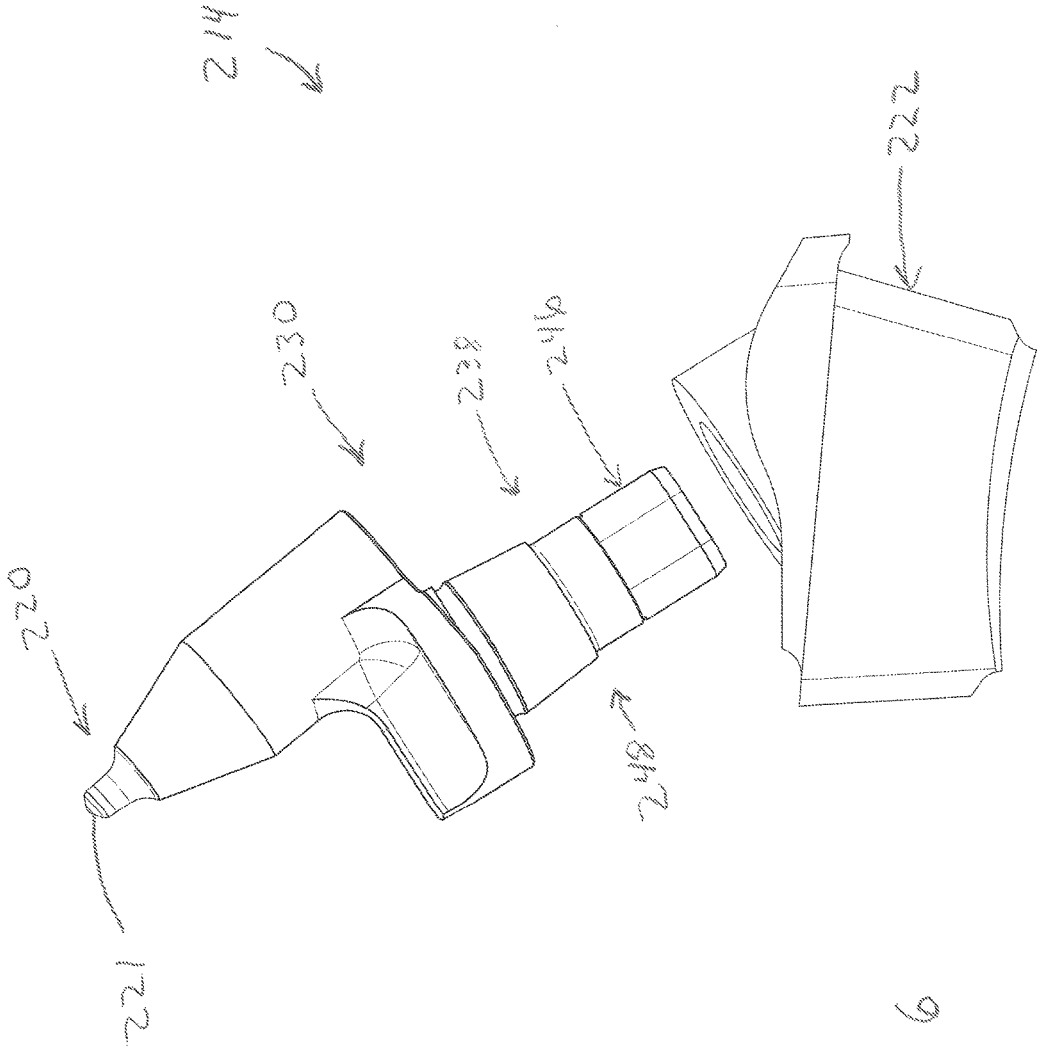

Referring to FIGS. 4 and 5, there is illustrated an additional tool holder 130, in accordance with another aspect of the invention. Specifically, tool holder 130 provides for at least a portion of anti-rotation portion 146 to taper inwardly toward the axial rearward end 142 of the trailing shank region 138. In one aspect, FIG. 4 illustrates that the opposing ends 158 may taper inwardly toward the axial rearward end 142. In another aspect, FIG. 5 illustrates that the opposing sides 156 may taper inwardly toward the axial rearward end 142.

Referring to FIG. 6, there is illustrated a combined cutting tool/tool holder-base assembly 214, in accordance with another aspect of the invention. Specifically, the assembly 214 includes a base 222 configured essentially the same as base 22 as described and illustrated herein. In addition, the assembly 214 includes a combined and/or integrally formed cutting tool portion 220 and tool holder portion 230. In other words, the cutting tool portion 220 and tool holder portion 230 are formed as a single component as opposed to the individually formed cutting tool 20 and tool holder 30 (shown, for example, in FIG. 1) that are removably attached to one another. The combined cutting tool portion 220 and tool holder portion 230 are inserted into the base 222 and once the cutting tool portion wears out or needs replaced the entire combined cutting tool portion 220 and tool holder portion 230 are removed and replaced as needed. In one aspect, the assembly 214 is particularly advantageous when a hard cutting member 221 is formed of a superhard material such as, but not limited to, polycrystalline diamond (PCD) or the like. In addition, the tool holder portion 230 includes a trailing shank region 238 having an anti-rotation portion 246 and mounting retention portion 248 configured, in one aspect, essentially the same as the trailing shank region 38 with anti-rotation portion 46 and mounting retention portion 48 as described and illustrated herein.

Whereas particular aspects of this invention have been described above for purposes of illustration, it will be evident to those skilled in the art that numerous variations of the details of the present invention may be made without departing from the invention as defined in the appended claims.

What is claimed is:

1. A mounting assembly adapted for attachment to a surface of a rotatable driving member of a cutting tool machine and adapted for receiving a cutting tool, the mounting assembly comprising:

a base having a bottom portion for attachment to the surface of the rotatable driving member and a front portion that defines a bore; and a tool holder configured for mounting to the base, the tool holder comprising:

a leading head region having a forward face that defines an aperture for receiving the cutting tool;

a trailing shank region with a central longitudinal axis and having an axial forward end and an axial rearward end; and a mediate region intermediate of and contiguous with the leading head region and the trailing shank region;

wherein the trailing shank region comprises an anti-rotation portion and a mounting retention portion;

the mounting retention portion including at least one press fit portion;

wherein the anti-rotation portion and the mounting retention portion are configured as a unitary member, and are disposed fully and continuously about the central longitudinal axis of the trailing shank region when viewed in a plane that is transverse to, and intersects, the central longitudinal axis of the trailing shank region;

wherein the anti-rotation portion comprises at least two sides which are not rounded; and wherein the anti-rotation portion is adjacent the axial rearward end of the trailing shank region;

wherein a portion of the bore of the base is configured to receive the anti-rotation portion; and the at least one press fit portion of the mounting retention portion comprises a rearward surface which does not contact any surface of the bore when the anti-rotation portion is received in the bore.

2. The mounting assembly of claim 1, wherein the at least two sides which are not rounded comprise at least one planar side.

3. The mounting assembly of claim 1, wherein at least a portion of the anti-rotation portion tapers inwardly toward the axial rearward end of the trailing shank region.

4. The mounting assembly of claim 1, wherein a portion of the bore of the base is configured to receive the anti-rotation portion of the trailing shank region.

5. The mounting assembly of claim 1, wherein the at least one press fit portion includes a tapered press fit portion that tapers axially rearward toward the anti-rotation portion.

6. The mounting assembly of claim 5, wherein the at least one press fit portion further includes a generally cylindrical press fit portion axially rearward of the tapered press fit portion and adjacent the anti-rotation portion.

7. The mounting assembly of claim 1, wherein the bore of the base is configured for receiving at least a portion of the trailing shank region of the tool holder and an axial rearward end of the bore is configured to have a shape complimentary to the anti-rotation portion of the trailing shank region.

8. A tool holder of a mounting assembly adapted for attachment to a surface of a rotatable driving member of a cutting tool machine, the tool holder adapted for receiving a cutting tool, the tool holder comprising:

a leading head region having a forward face that defines an aperture for receiving the cutting tool;

a trailing shank region with a central longitudinal axis and having an axial forward end and an axial rearward end; and a mediate region intermediate of and contiguous with the leading head region and the trailing shank region;

wherein the trailing shank region comprises an anti-rotation portion and a mounting retention portion;

wherein the anti-rotation portion and the mounting retention portion are configured as a unitary member, and are disposed fully and continuously about the central longitudinal axis of the trailing shank region when viewed in a plane that is transverse to, and intersects, the central longitudinal axis of the trailing shank region;

wherein the anti-rotation portion comprises at least two sides which are not rounded; and wherein the anti-rotation portion is adjacent the axial rearward end of the trailing shank region; and a chamfer disposed at the axial rearward end of the trailing shank region;

wherein the chamfer assists in alignment of the tool holder with respect to a bore, when mounting the tool holder in a bore.

9. The tool holder of claim 8, wherein the at least two sides which are not rounded comprise at least one planar side.

10. The tool holder of claim 8, wherein at least a portion of the anti-rotation portion tapers inwardly toward the axial rearward end of the trailing shank region.

11. The tool holder of claim 8, wherein the mounting retention portion includes a tapered press fit portion that tapers axially rearward toward the anti-rotation portion.

12. The tool holder of claim 8, wherein the mounting retention portion further includes a generally cylindrical press fit portion axially rearward of the tapered press fit portion and adjacent the anti-rotation portion.

13. A tool holder of a mounting assembly adapted for attachment to a surface of a rotatable driving member of a cutting tool machine, the tool holder adapted for receiving a cutting tool, the tool holder comprising:

a head having a forward face that defines an aperture for receiving the cutting tool; and a shank with a central longitudinal axis and having an axial forward end and an axial rearward end, the shank comprising:

an anti-rotation portion; and a mounting retention portion;

wherein the anti-rotation portion and the mounting retention portion are configured as a unitary member, and are disposed fully and continuously about the central longitudinal axis of the trailing shank region when viewed in a plane that is transverse to, and intersects, the central longitudinal axis of the trailing shank region;

wherein the mounting retention portion includes a tapered press fit portion that tapers axially rearward and a generally cylindrical press fit portion;

wherein the anti-rotation portion comprises at least two sides which are not rounded;

wherein the anti-rotation portion is adjacent the axial rearward end of the shank; and wherein the tapered press fit portion, the generally cylindrical press fit portion and the anti-rotation portion each have an axial length, defined with respect to the central longitudinal axis;

the axial length of the anti-rotation portion being greater than the axial length of the tapered press fit portion and of the generally cylindrical press fit portion.

14. The mounting assembly of claim 2, wherein the at least one planar side comprises two planar sides, which are interconnected when viewed in a plane that is transverse to, and intersects, the central longitudinal axis of the trailing shank region.

15. The mounting assembly of claim 14, wherein:

the anti-rotation portion comprises two opposing planar sides and two opposing rounded ends;

the two planar sides and the two rounded ends combining to fully and continuously surround the central longitudinal axis of the trailing shank region when viewed in a plane that is transverse to, and intersects, the central longitudinal axis of the trailing shank region.

16. The mounting assembly of claim 2, wherein the at least one planar side comprises a planar side defined by a flat, planar surface area.

17. The mounting assembly of claim 7, wherein the anti-rotation portion engages with the complimentary shape of the axial rearward end of the bore solely via surface-to-surface engagement.

18. The mounting assembly of claim 6, wherein:

the generally cylindrical press fit comprises the rearward surface which does not contact any surface of the bore when the anti-rotation portion is received in the bore.

* * * * *